US008813589B2

(12) United States Patent
Tang

(10) Patent No.: US 8,813,589 B2
(45) Date of Patent: Aug. 26, 2014

(54) ECCENTRIC MOMENT STEPLESS ADJUSTABLE VIBRATING MECHANISM

(76) Inventor: Zhongsheng Tang, Nanning (CN)

( * ) Notice: Subject to any disclaimer, the term of this patent is extended or adjusted under 35 U.S.C. 154(b) by 0 days.

(21) Appl. No.: 13/384,437

(22) PCT Filed: Dec. 31, 2010

(86) PCT No.: PCT/CN2010/002228

§ 371 (c)(1),
(2), (4) Date: Jan. 17, 2012

(87) PCT Pub. No.: WO2012/068711

PCT Pub. Date: May 31, 2012

(65) Prior Publication Data

US 2013/0233101 A1 Sep. 12, 2013

(30) Foreign Application Priority Data

Nov. 22, 2010 (CN) ..... 2010 1 0553270
Nov. 22, 2010 (CN) ..... 2010 2 0617699 U

(51) Int. Cl.
*B06B 1/16* (2006.01)
*E02D 7/18* (2006.01)

(52) U.S. Cl.
CPC .. *B06B 1/162* (2013.01); *E02D 7/18* (2013.01)
USPC ..... 74/87; 74/61

(58) Field of Classification Search
USPC ..... 74/87, 61; 173/49; 198/533, 609; 56/340.1; 404/133.05
See application file for complete search history.

(56) References Cited

U.S. PATENT DOCUMENTS 2,102,603 A * 12/1937 Pinazza ..... 173/49
2,404,377 A * 7/1946 Herbst ..... 74/10.54

(Continued)

FOREIGN PATENT DOCUMENTS

CN 88 2 03949 U 11/1988
CN 101503873 A 8/2009

(Continued)

OTHER PUBLICATIONS

PCT/ISA/210 for PCT/CN2010/002228 mailed Aug. 18, 2011.

(Continued)

*Primary Examiner* — Troy Chambers
*Assistant Examiner* — Valentin Craciun
(74) *Attorney, Agent, or Firm* — RatnerPrestia

(57) ABSTRACT

The present invention relates to an eccentric moment stepless adjustable vibrating mechanism comprising a box body. At least four eccentric shafts are installed on the box body, wherein half of the eccentric shafts are arranged side by side at the upper part of the box body to form the eccentric group of an upper layer, and the other half of the eccentric shafts are arranged side by side at the lower part of the box body to form the eccentric group of a lower layer, each eccentric shaft is provided with an eccentric block and a gear, the gears of the eccentric group of the upper layer are meshed with each other, the gears of the eccentric group of the lower layer are meshed with each other; one of the eccentric shafts of the eccentric group of the upper layer is connected with a first hydraulic motor and the other eccentric shaft thereof is provided with an upper chain wheel; one of the eccentric shafts of the eccentric group of the lower layer is connected with a second hydraulic motor and the other eccentric shaft thereof is provided with a lower chain wheel; the upper and lower chain wheels are connected with each other by a chain; two adjusting chain wheels which are connected with each other by a connecting rod are arranged between the eccentric groups of the upper and lower layers; the two adjusting chain wheels are both connected with the chain; and the connecting rod is fixedly connected with a telescopic rod of a hydraulic cylinder installed on the box body. The present invention can realize the optional adjusting control of working amplitude of an engineering machine, is favorable to prolong the service life of the machine, improves working efficiency and working adaptability, and has strong practicability and wide market application prospect.

2 Claims, 2 Drawing Sheets

(56) References Cited

U.S. PATENT DOCUMENTS

| | | | | | |
|---|---|---|---|---|---|
| 2,457,413 | A | * | 12/1948 | Stokes et al. | 74/87 |
| 2,958,227 | A | * | 11/1960 | Peterson | 74/61 |
| 3,433,311 | A | * | 3/1969 | Lebelle | 173/49 |
| 3,442,381 | A | * | 5/1969 | Johnson | 209/326 |
| 3,457,712 | A | * | 7/1969 | Gould et al. | 56/340.1 |
| 3,465,599 | A | * | 9/1969 | Brander et al. | 74/61 |
| 3,948,109 | A | * | 4/1976 | Elonen | 74/61 |
| 5,064,053 | A | * | 11/1991 | Baker | 198/753 |
| 5,458,204 | A | * | 10/1995 | Tunkers | 173/49 |
| 5,860,321 | A | * | 1/1999 | Williams et al. | 74/143 |
| 6,349,834 | B1 | * | 2/2002 | Carr et al. | 209/366.5 |

FOREIGN PATENT DOCUMENTS

| | | | |
|---|---|---|---|
| CN | 101581096 | A | 11/2009 |
| CN | 101864772 | A | 10/2010 |
| CN | 101886389 | A | 11/2010 |
| JP | 5-237459 | | 9/1993 |

OTHER PUBLICATIONS

PCT/ISA/237 for PCT/CN2010/002228 mailed Aug. 18, 2011.

* cited by examiner

ECCENTRIC MOMENT STEPLESS ADJUSTABLE VIBRATING MECHANISM

This application is a U.S. National Phase Application of PCT International Application No. PCT/CN2010/002228, filed Dec. 31, 2010 which claims priority to Chinese Patent Application No. 201010553270.7, filed Nov. 22, 2010 and Chinese Patent Application No. 201020617699.3, filed Nov. 22, 2010, the contents of such applications being incorporated by reference herein.

FIELD OF THE INVENTION

The present invention relates to the technical field of engineering machine, in particular to an eccentric moment stepless adjustable vibrating mechanism.

BACKGROUND OF THE INVENTION

At present, in various fields where eccentric vibrating mechanisms are used, for example in the engineering machines, such as hydraulic vibrating pile hammer, percussion drill, vibrating roller, vibrating crusher etc., which need vibration operation, in order to improve working efficiency, different optimum amplitudes need to be selected according to different operating conditions, and in order to avoid the machine from being damaged by resonance generated by a resonance area when the machine starts or shuts down, the eccentric moment is desired to be adjustable.

At present, in the eccentric moment adjusting schemes domestic and abroad, the following several forms are mainly comprised: (1) manual adjustment, wherein the eccentric moment is adjusted through changing the phase or weight of an eccentric block, and the machine must shut down during the adjustment; (2) impact block with two-stage, wherein the angle between a movable eccentric block and a fixed eccentric block is changed through the rotation in forward direction and in reverse direction of a motor, so that the purpose of changing the eccentric moment can be achieved, and the principle of this method is similar to that of the manual adjustment scheme in China, and the structure is simple, but the number of the grades of variable moment is limited, such as Chinese patent publication No. CN101503873, titled with "Eccentric Vibrating Mechanism"; (3) sliding gear, wherein the axial movement of a big helical angle herringbone gear is utilized to relatively rotate two groups of synchronizing gears which are meshed with the herringbone gear, so that the purpose of eccentric moment stepless adjustment can be achieved, and this mechanism can obviously realize stepless frequency adjustment, but has a comparatively complex structure, requires the gears having high synchronizing precision, and has poor reliability, such as Chinese patent publication No. CN101581096, titled with "Eccentric Moment Adjustable Hydraulic Vibrating Pile Hammer"; and (4) adjusting shaft with four-shaft helical splines, wherein two segments of steep-lead helical splines with opposite rotation directions are made on the adjusting shaft, the splines are at both ends respectively provided with a gear, wherein one gear is meshed with a synchronizing gear below, and the other gear is meshed with a synchronizing gear above through an intermediate gear, the adjusting shaft slides along the axial direction, and the lower group of eccentric blocks is relatively rotated with respect to the upper group of eccentric blocks, so that the purpose of stepless frequency adjustment can also be achieved. However, this mechanism is bulky, and requires extraordinary high precision, and has poor controlling performance and high cost.

Therefore, in the existing various moment adjustment modes of vibrating pile hammer domestic and abroad, some of them have poor adjusting ability, and some of them have complex mechanisms, especially in the gear rigid synchronous drive mode. Since the structure is complex, the driving members such as gear are easy to be damaged, with the result that the vibrating mechanism in the stepless moment adjustment type is still hard to be generalized until now.

SUMMARY OF THE INVENTION

The purpose of the present invention is to provide an eccentric moment stepless adjustable vibrating mechanism which can adjust the eccentric moment in a stepless and continuous way, has s simple structure, is convenient to control moment adjustment process, is simple to be installed and maintained, and has low manufacturing cost.

The present invention solves the above technical problem with the following technical scheme: an eccentric moment stepless adjustable vibrating mechanism comprises a box body, on which at least four eccentric shafts are installed, wherein half of the eccentric shafts are arranged side by side at the upper part of the box body to form the eccentric group of an upper layer, and the other half of the eccentric shafts are arranged side by side at the lower part of the box body to form the eccentric group of a lower layer, wherein each eccentric shaft is provided with an eccentric block and a gear, the gears of the eccentric group of the upper layer are meshed with each other, the gears of the eccentric group of the lower layer are meshed with each other; one of the eccentric shafts of the eccentric group of the upper layer is connected with a first hydraulic motor and the other eccentric shaft thereof is provided with an upper chain wheel; one of the eccentric shafts of the eccentric group of the lower layer is connected with a second hydraulic motor and the other eccentric shaft thereof is provided with a lower chain wheel; the upper and lower chain wheels are connected with each other by a chain; two adjusting chain wheels which are connected with each other by a connecting rod are arranged between the eccentric groups of the upper and lower layers; the two adjusting chain wheels are both connected with the chain; and the connecting rod is fixedly connected with a telescopic rod of a hydraulic cylinder installed on the box body.

An elastic spring is installed on the connecting rode which is used for connecting the two adjusting chain wheels.

The present invention breaks through the traditional eccentric moment adjustment modes, adopts neither the complex adjusting mechanism which changes the rotary inertia of the eccentric block, nor the simple frequency adjustment scheme in which the amplitude and the frequency are changed simultaneously, but realizes the composition of amplitude vectors through controlling and changing the phase difference between upper and lower layers of eccentric blocks, so that the independent amplitude adjustment can be realized simply and skillfully.

The present invention can realize the optional adjusting control of working amplitude of an engineering machine such as hydraulic vibrating pile hammer, vibrating roller and the like so as to meet high efficient construction requirements under various geologic conditions, at the same time can effectively overcome the defect caused by the resonance area when the machine such as the hydraulic vibrating pile hammer etc. starts or shuts down, is favorable to prolong the service life of the machine, improves working efficiency and working adaptability, provides good operability for the computerized control of eccentric vibrating machine, and has strong practicability and wide market application prospect. The present invention can be applied in the engineering machines such as hydraulic vibrating pile hammer, percussion drill, vibrating roller, vibrating crusher and the like.

Figure 1:
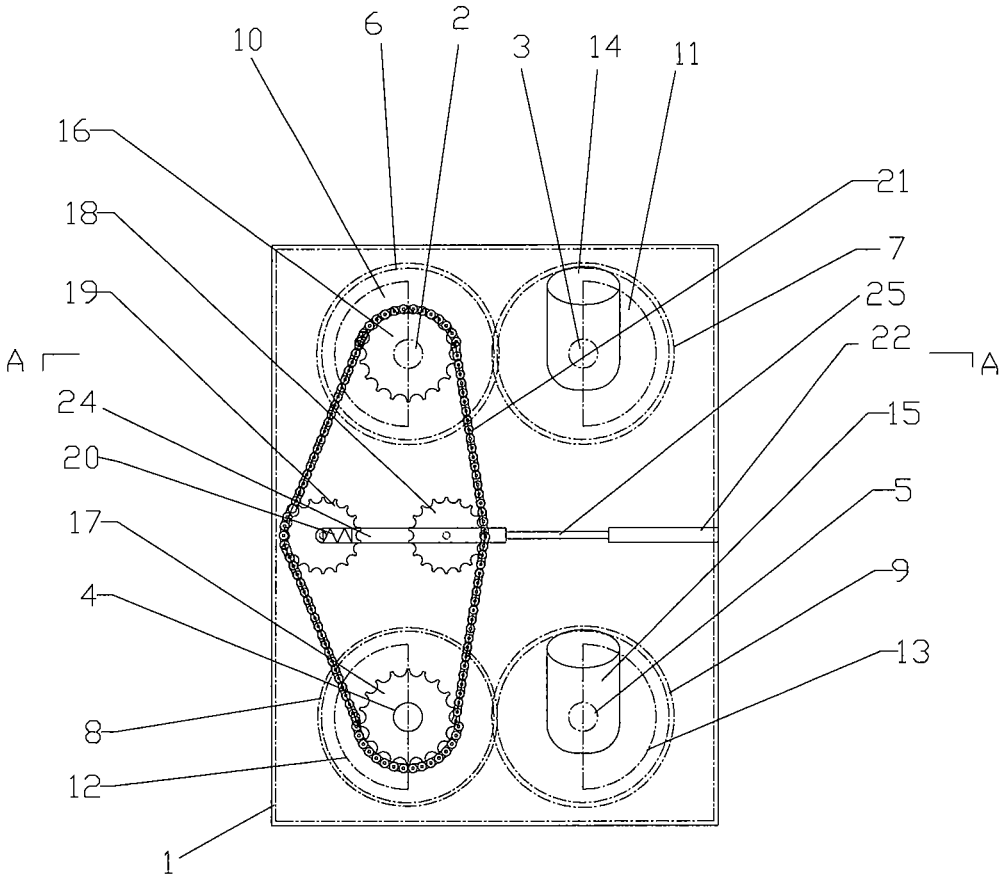
FIG. 1 is a structural schematic view of an eccentric moment stepless adjustable vibrating mechanism according to the present invention.
Figure 2:
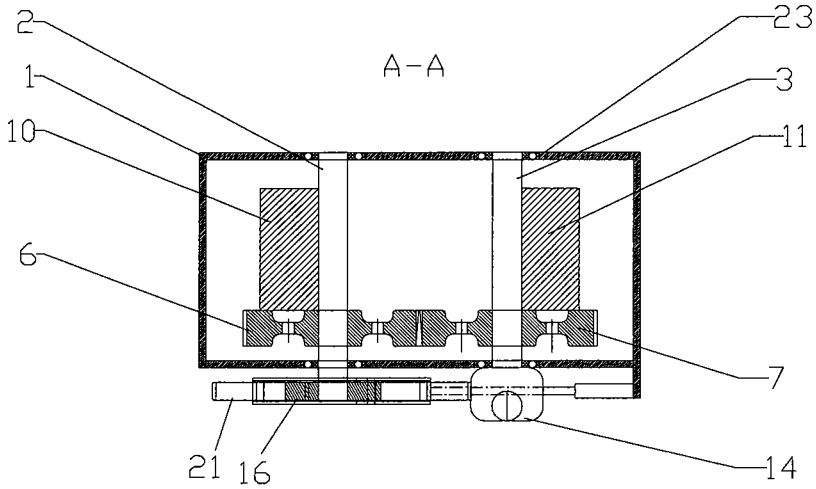
FIG. 2 is a sectional schematic view taken along line A-A in FIG. 1.

In the figures: box body 1, first eccentric shaft 2, second eccentric shaft 2, third eccentric shaft 4, fourth eccentric shaft 5, first gear 6, second gear 7, third gear 8, fourth gear 9, first eccentric block 10, second eccentric block 11, third eccentric block 12, fourth eccentric block 13, first hydraulic motor 14, second hydraulic motor 15, upper chain wheel 16, lower chain wheel 17, right adjusting chain wheel 18, left adjusting chain wheel 19, elastic spring 20, chain 21, hydraulic cylinder 22, bearings 23, connecting rod 24, telescopic rod 25.

DETAILED DESCRIPTION OF THE EMBODIMENTS

The present invention will be further detailed hereafter in connection with the drawings.

A first eccentric shaft 2 and a second eccentric shaft 3 are installed side by side at the upper part of a box body 1 to form the eccentric group of an upper layer. A third eccentric shaft 4 and a fourth eccentric shaft 5 are installed side by side at the lower part of the box body 1 to form the eccentric group of a lower layer. The above four eccentric shafts are all connected with the box body through bearings 23. The first eccentric shaft 2 is provided with a first eccentric block 10, a first gear 6 and an upper chain wheel 16. The second eccentric shaft 3 is provided with a second eccentric block 11 and a second gear 7. The second eccentric shaft 3 is connected with a first hydraulic motor 14. The second gear 7 is meshed with the first gear 6. The third eccentric shaft 4 is provided with a third eccentric block 12, a third gear 8 and a lower chain wheel 17. The fourth eccentric shaft 5 is provided with a fourth eccentric block 13 and a fourth gear 9. The fourth eccentric shaft 5 is connected with a second hydraulic motor 15. The fourth gear 9 is meshed with the third gear 8. The upper chain wheel 16 is connected with the lower chain wheel 17 by a chain 21. A left adjusting chain wheel 19 and a right adjusting chain wheel 18 are arranged between the eccentric groups of the upper and lower layers. The left adjusting chain wheel 19 is connected with the right adjusting chain wheel 18 by a connecting rod 24 on which an elastic spring 20 is arranged. The two adjusting chain wheels are both connected with the chain 21. The connecting rod 24 is fixedly connected with a telescopic rod 25 of a hydraulic cylinder 22 installed on the box body 1.

During operation, the second eccentric shaft 3 and the fourth eccentric shaft 5 are driven to rotate by the two hydraulic motors 14, 15, respectively, at the same time the first eccentric shaft 2 and the third eccentric shaft 4 connected through gear sets also rotate accordingly. The present invention ensures that the eccentric blocks of the eccentric groups of the upper and lower layers can be operated synchronously, so that the components in horizontal direction of the centrifugal force generated by the rotation of the eccentric blocks are neutralized with one another, while the components in perpendicular direction are added to generate exciting forces.

Thanks to the chain connection between the eccentric groups of the upper and lower layers, the present invention ensures that the four eccentric shafts have the same rotating speed during rotation, and the phase difference of the eccentric blocks maintains unchanged.

Figure 3:
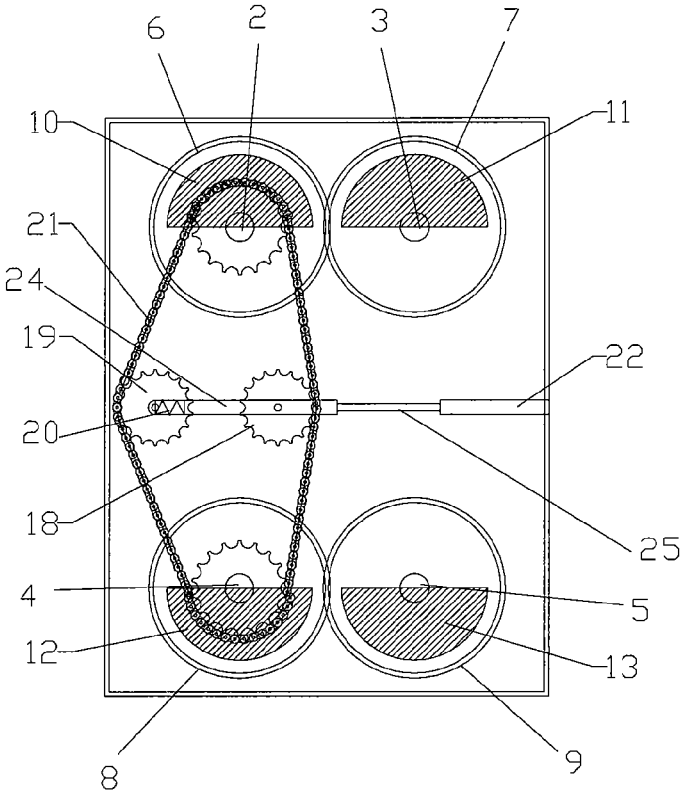
FIG. 3 is a state schematic view in which there is 180 degrees of phase difference between the eccentric blocks of the eccentric group of an upper layer and the eccentric blocks of the eccentric group of a lower layer in FIG. 1.
Figure 4:
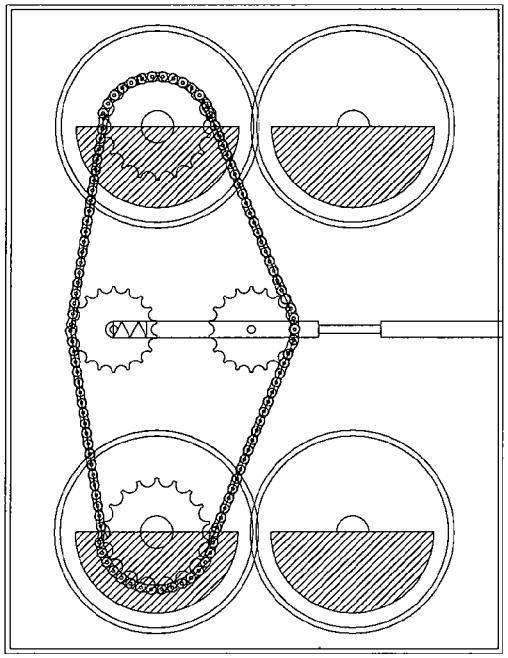
FIG. 4 is a state schematic diagram in which there is 0 degree of phase difference between the eccentric blocks of the eccentric group of the upper layer of and the eccentric blocks of the eccentric group of the lower layer in FIG. 1.

When the phase difference of the eccentric blocks of the eccentric groups of the upper and lower layers needs to be changed to obtain different exciting forces, the two adjusting chain wheels 18, 19 are driven by the hydraulic cylinder 22 to move horizontally at the same time. When the two adjusting chain wheels move to a position where the phase difference of the eccentric blocks of the eccentric groups of the upper and lower layers is 180 degrees as shown in FIG. 3, the exciting forces in the perpendicular direction are neutralized to be zero. When the exciting forces need to be increased, the two adjusting chain wheels 18, 19 are driven by the hydraulic cylinder 22 to move to the right at the same time as shown in FIG. 4. At this time, since the right adjusting chain wheel 18 exerts a force suddenly to make the chain pull the upper chain wheel 16 for an instant, the phase difference between the eccentric blocks of the eccentric group of the upper layer and the eccentric blocks of the eccentric group of the lower layer changes. When the phases of the eccentric groups of the two layers are consistent, the exciting forces in the perpendicular direction are added with one another to reach the maximum value. Therefore, as long as the two adjusting chain wheels are driven to move by the hydraulic cylinder 22, the phase difference of the eccentric blocks of the eccentric groups of the upper and lower layers can be changed, i.e., the continuous stepless adjusting control can be realized in which the eccentric moment in the perpendicular direction is in the ranges from zero to maximum and from maximum to zero.

Since the elastic spring 20 is arranged on the connecting rod 24 which is used for connecting the two adjusting chain wheels, the two adjusting chain wheels can always maintain in the tight connection with the chain 21 during movement.

In the present invention, the number of the eccentric shafts of the eccentric group of the upper or lower layer is not limited to two. A structure with the eccentric groups in a plurality of layers or rows can also be adopted. The number of the hydraulic motors used in the present invention is not limited to two, one hydraulic motor or more than two hydraulic motors can be used, and electric motors or other power driving means can also be used to replace the hydraulic motor.

What is claimed is:

1. An eccentric moment stepless adjustable vibrating mechanism comprises a box body, on which at least four eccentric shafts are installed, wherein half of the eccentric shafts are arranged side by side at the upper part of the box body to form the eccentric group of an upper layer, and the other half of the eccentric shafts are arranged side by side at the lower part of the box body to form the eccentric group of a lower layer, wherein each eccentric shaft is provided with an eccentric block and a gear, the gears of the eccentric group of the upper layer are meshed with each other, the gears of the eccentric group of the lower layer are meshed with each other; one of the eccentric shafts of the eccentric group of the upper layer is connected with a first hydraulic motor and the other eccentric shaft thereof is provided with an upper chain wheel; one of the eccentric shafts of the eccentric group of the lower layer is connected with a second hydraulic motor and the other eccentric shaft thereof is provided with a lower chain wheel; the upper and lower chain wheels are connected with each other by a chain; two adjusting chain wheels which are connected with each other by a connecting rod are arranged between the eccentric groups of the upper and lower layers; the two adjusting chain wheels are both connected with the chain; and the connecting rod is fixedly connected with a telescopic rod of a hydraulic cylinder installed on the box body.

2. The eccentric moment stepless adjustable vibrating mechanism according to claim 1, wherein an elastic spring is installed on the connecting rod which is used for connecting the two adjusting chain wheels.

* * * * *